United States Patent [19]

Nishimura et al.

[11] 3,934,399

[45] Jan. 27, 1976

[54] ELECTRIC TIMEPIECE INCORPORATING RECTIFIER AND DRIVING CIRCUITS INTEGRATED IN A SINGLE CHIP

[75] Inventors: Izuhiko Nishimura; Tadashi Sano, both of Suwa, Japan

[73] Assignee: Kabushiki Kaisha Seikosha, Tokyo, Japan

[22] Filed: Jan. 11, 1974

[21] Appl. No.: 432,720

Related U.S. Application Data

[63] Continuation-in-part of Ser. No. 369,339, June 12, 1973, abandoned.

[30] Foreign Application Priority Data

| | | |
|---|---|---|
| June 12, 1972 | Japan | 47-58476 |
| May 24, 1973 | United Kingdom | 24848/73 |
| June 12, 1973 | Germany | 2329875 |
| June 12, 1973 | France | 73.7321241 |
| June 12, 1973 | Switzerland | 8459/73 |

[52] U.S. Cl. ..... 58/23 R; 357/42

[51] Int. Cl.[2] ..... G04C 3/00

[58] Field of Search ..... 58/23 BA, 23 R; 307/303; 357/42

[56] References Cited

UNITED STATES PATENTS

| | | | |
|---|---|---|---|
| 3,505,804 | 4/1970 | Hofstein | 58/23 BA |
| 3,541,357 | 11/1970 | Kram | 307/303 |
| 3,649,887 | 3/1972 | Keller et al. | 307/303 X |
| 3,668,860 | 6/1972 | Diersbock | 58/23 BA |
| 3,712,995 | 1/1973 | Steudel | 357/42 |
| 3,757,510 | 9/1973 | Dill | 58/23 R |
| 3,818,484 | 6/1974 | Nakamura et al. | 58/23 BA |

OTHER PUBLICATIONS

RCA, COS/MOS Integrated Circuits Manual, pp. 24–26, 1971.

*Primary Examiner*—L. T. Hix
*Assistant Examiner*—U. Weldon
*Attorney, Agent, or Firm*—Blum, Moscovitz, Friedman & Kaplan

[57] ABSTRACT

A timepiece having a quartz crystal vibrator serving as a time standard, a digital display, and integrated divider and C-MOS transistor driving circuits for dividing the high frequency signal from the vibrator into low frequency timing signals for the direct driving of the liquid crystal display. A battery energizes the vibrator and divider circuits but the voltage thereof is insufficient for energizing the display driving circuits. Said voltage is stepped up by a circuit including a rectifier circuit monolithically integrated on the same substrate as said complementary coupled transistor integrated driving circuit and produces a voltage sufficient to energize the driving circuit.

9 Claims, 7 Drawing Figures

FIG. 1
PRIOR ART
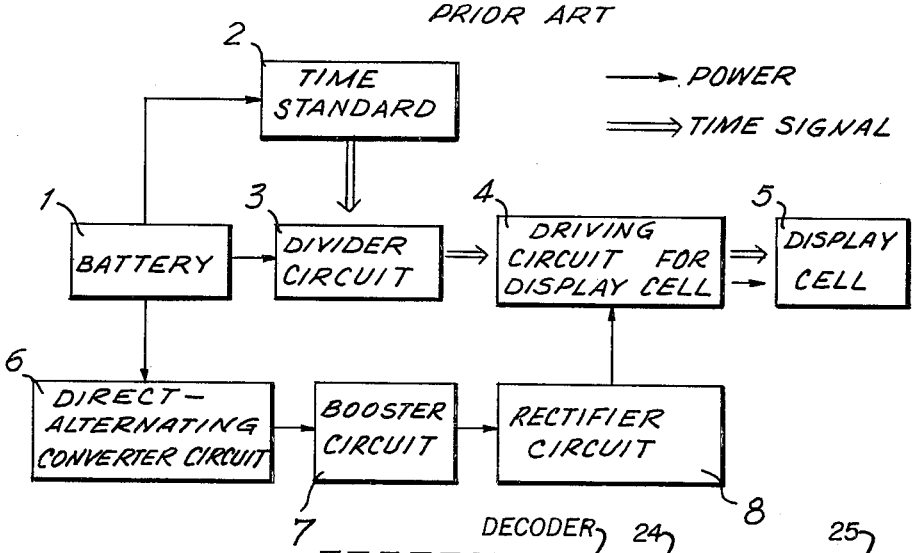
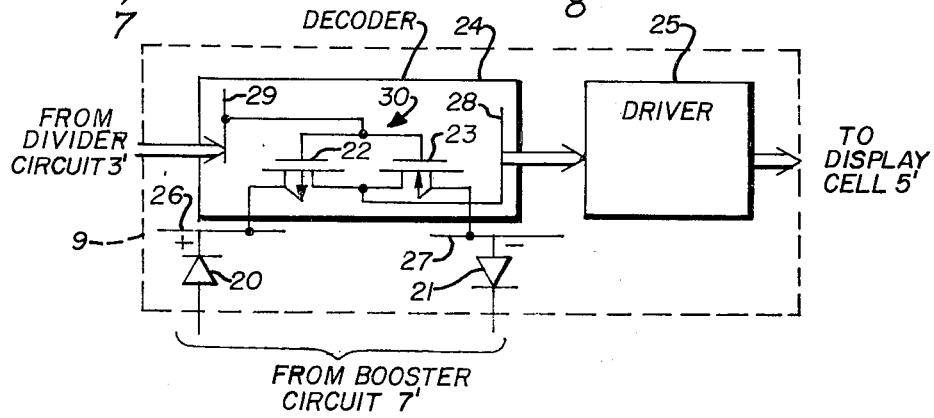
FIG. 7
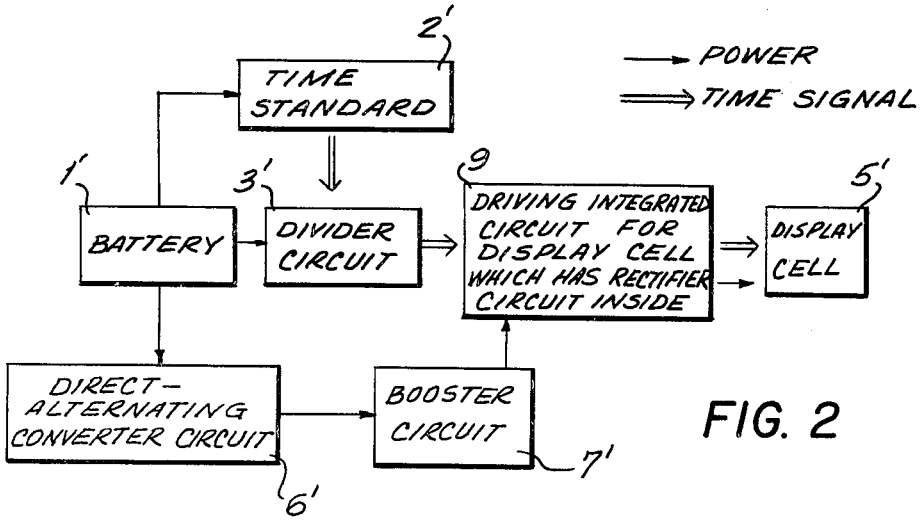
FIG. 2

ELECTRIC TIMEPIECE INCORPORATING RECTIFIER AND DRIVING CIRCUITS INTEGRATED IN A SINGLE CHIP

CROSS REFERENCE TO RELATED APPLICATION

This application is a continuation-in-part of our application Ser. No. 369,339 filed on June 12, 1973 now abandoned.

BACKGROUND OF THE INVENTION

This invention relates to the construction of quartz crystal timepieces and in particular to quartz crystal wristwatches incorporating liquid crystal display means. It is essential to provide divider and driving circuitry which draws a minimum of power in order to maximize the life of the battery provided in such timepieces. Further, it is also essential that the space utilized by the battery be kept to a minimum in order to make the circuit adaptable for use in a wristwatch. The batteries generally provided in quartz crystal timepieces provide voltages within the range of 1.2–3.5 volts (usually 1.3–1.5 volts) while the liquid crystal displays generally require voltages of 10 to 30 volts in order to operate effectively although voltages as low as 3 volts may be used in certain displays. For this reason, means for stepping up the voltage of the battery in the timepiece by use of miniature components has been provided. Nevertheless, the voltage step-up circuitry of the prior art is separately mounted within the watch, occupying a large amount of space and, in some instances, resulting in a lowering of reliability.

SUMMARY OF THE INVENTION

Generally speaking, in accordance with the invention, a timepiece is provided having a quartz crystal vibrator for producing a high frequency time standard signal, divider circuit means coupled to said quartz crystal vibrator for producing low frequency time signals from said high frequency time standard signal, a digital display means and C-MOS transistor integrated driving circuit means coupled intermediate said divider means and said display means for directly driving the same. A single battery of a first d.c. potential is further provided and is coupled to the vibrator and divider circuit means for the energization thereof. Means are provided for converting the d.c. signal to an a.c. signal, stepping up the voltage of the a.c. signal, and rectifying the stepped-up a.c. signal for energizing the integrated driving circuit means. Said driving circuit means which include complementary coupled transistors and the rectifier circuit for rectifying the stepped-up a.c. signal are monolithically integrated on the same substrate.

Accordingly, the object of the invention is to provide a highly accurate and compact electronic crystal wristwatch having no moving parts.

Another object of the invention is to provide a practical electronic wristwatch including a liquid crystal display driven by only one conventional type battery.

A further object of the invention is to provide improved means for driving digital displays for electric timepieces in general and electric watches in particular.

Still a further object of the invention is to provide an improved integrated circuit chip including a complementary coupled transistor driving circuit and a rectifying circuit.

Still other objects and advantages of the invention will in part be obvious and will in part be apparent from the specification and drawings.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a block diagram of a conventional quartz crystal timepiece;

FIG. 2 is a block diagram of a quartz crystal timepiece in accordance with instant invention;

FIG. 7 is a block and circuit diagram of the driving integrated circuit for display cell having rectifier circuit inside, of FIG. 2, constructed in accordance with FIG. 6.

DESCRIPTION OF THE PREFERRED EMBODIMENT

Figure 3:
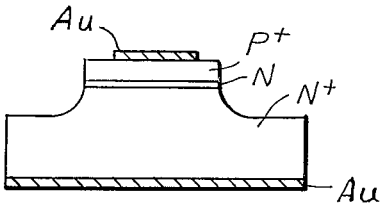
FIG. 3 is a sectional view of a high speed switching diode integrated circuit element.

Referring now to FIG. 1, a conventional quartz crystal timepiece is illustrated therein and includes a battery 1, a time standard oscillator 2, divider circuit 3, a driving circuit 4, and display cell 5. The battery 1 is a standard low voltage cell which is capable of supplying a low d.c. voltage of between 1.2 and 3.5 volts. The time standard oscillator 2 is an oscillator consisting of a quartz crystal vibrator adapted to produce a high frequency time standard signal. Divider circuit 3 includes a series-connected divider chain for dividing the high frequency time standard signal into low frequency time signals such as a one-second signal or a one-minute signal. The driving circuit 4 is formed for decoding the time signals received from the divider circuit and applying same to those portions of the display cell 5 which when energized, will provide a digital time display. A driving voltage of 10 to 30 volts is required to operate the display cell, although the logic circuitry of the driving circuit 4 is switched by the relatively low voltage time signals. Although the time standard oscillator 2 and the divider circuit 3 are energized by the low potential from the battery 1, a higher d.c. potential is required to effect operation of the display cell by the driving circuit 4. The display cells 5 may be formed from liquid crystal material, PLZT-type ferroelectric material, or the like. The higher d.c. potential is achieved by supplying the d.c. signal from the battery 1 to a circuit 6 for converting the d.c. signal supplied to an a.c. signal, such circuit being formed of a standard oscillator circuit. The a.c. signal is then supplied to a booster circuit 7, which booster circuit 7 is comprised of a conventional electronic amplifier or a transformer for stepping up the voltage of the a.c. signal. The stepped up a.c. signal is then supplied to a separate rectifier circuit 7 to provide a d.c. signal of higher potential than is supplied by the battery 1. The higher potential d.c. signal is then supplied to the driving circuit 4 to permit said driving circuit to energize the power which allows the driving circuit to drive the display cell in response to the low voltage time signals supplied from divider circuit 3 to driving circuit 4.

Figure 6:
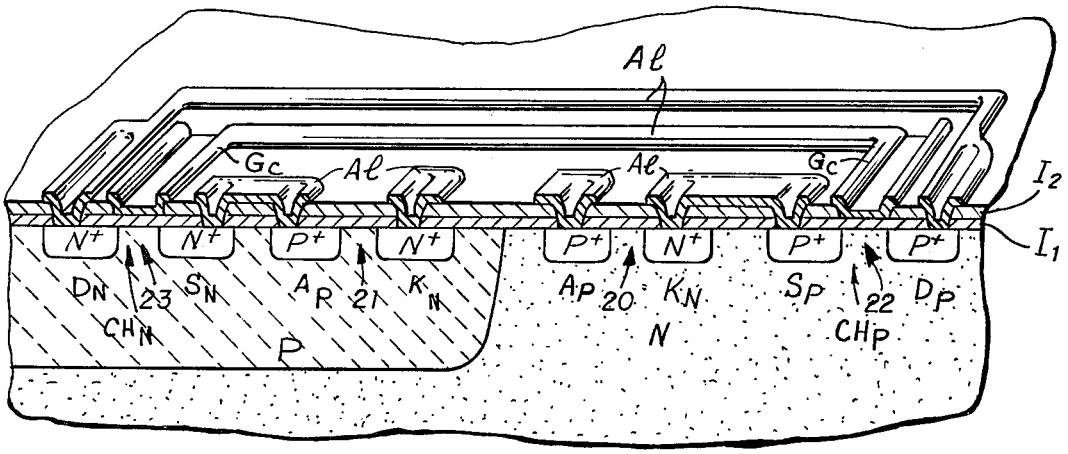
FIG. 6 is a fragmentary, sectioned perspective view of an integrated circuit chip wherein the C-MOS transistor inverter circuit and rectifier diode circuit depicted in FIG. 2 are monolithically integrated into a single chip in accordance with the instant invention.

Referring now to FIG. 2, the quartz crystal timepiece of the instant invention is therein illustrated. In order to reduce the size of the components which are incorporated into the desired small watch case, a new monolithic integrated C-MOS transistor driving circuit partially depicted in FIG. 6, is utilized which includes both the rectifier circuit and driving circuit integrated into a single substrate. Thus, time standard circuit 2' provides a timing signal of a high frequency to divider circuit 3', which in turn is coupled to the monolithic integrated driving and rectifying circuit 9, which when energized by a higher potential drives display cell 5'. With this new arrangement, all that is required is a separate converter circuit 6' for converting a low potential d.c. signal to an a.c. signal and booster circuit 7' for stepping up the voltage of the a.c. signal. The stepped up a.c. signal is then supplied to the monolithic integrated driving and rectifier circuit 9 for conversion to d.c. to provide the driving voltage for the display cell, time signals being applied thereto from divider circuit 3'. Both the divider and driver-rectifier circuits are formed of monolithically integrated circuit elements, the divider and driver circuits being formed of C-MOS transistors.

Reference is now made to FIG. 3, wherein an integrated mesa type high speed switching diode is depicted. The N layer is provided with a low carrier concentration and is epitaxially grown on the $N^+$ substrate. A $P^+$ layer is then diffused thereon and conductors Au are layered on the top and bottom to define the electrodes of the diode. It is understood that the switching speed of such a diode is dependent on the thickness of the $N^+$ layer.

Figure 4:
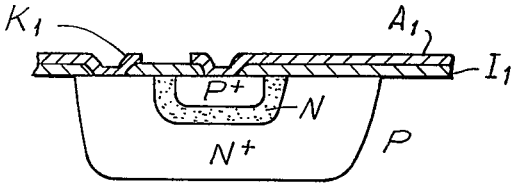
FIG. 4 is a fragmentary sectional view of a power type diode integrated circuit element.

Reference is now made to FIG. 4 wherein a power type diode integrated circuit is depicted. In such a power type diode a diffusion layer $N^+$ having a high carrier concentration sometimes referred to as a buried layer is diffused into the P layer in order to lower the forward resistance. Then, the N layer and $P^+$ layer are formed by epitaxial techniques. An insulating layer $I_1$ is then placed over the formed layers and metal conductors $K_1$ and $A_1$ are placed in contact with the $N^+$ and $P^+$ layers respectively to define the diode's cathode and anode respectively. Often the cathode is placed on the lower part of the substrate in contact with the $N^+$ layer.

Figure 5:
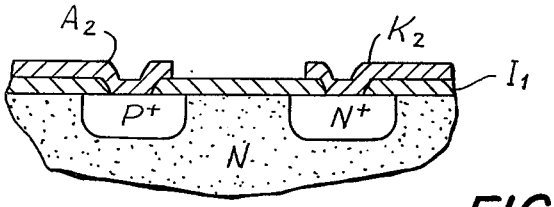
FIG. 5 is a fragmentary sectional view of a low power rectifier diode integrated circuit element constructed in accordance with the instant invention.

Reference is now made to FIG. 5 wherein a low power rectifying diode integrated circuit is constructed in accordance with the instant invention. Because no operational limitations such as high speed switching or high power operation are required, the simple structure of FIG. 5 is particularly suited for use in an electronic timepiece. In order to construct such a rectifier diode, the operative layers formed from silicon may be directly diffused into a substrate and the metallic wiring deposited on the surface of the substrate. A $P^+$ layer is diffused in the N substrate to define a P-N junction. An $N^+$ layer having a high carrier concentration is diffused into the N layer and serves as a current medium because the substrate N which has a low carrier concentration cannot be in obvious contact with the metal conductors. An insulating film such as $SiO_2$, depicted in FIG. 5 as $I_1$ insulates the metal conductors $A_2$ and $K_2$ from the substrate which conductors define the anode and cathode respectively.

Reference is now made to FIG. 6 wherein a C-MOS inverter circuit of a driving circuit and the rectifier diode circuit are monolithically integrated into a single chip. The N-channel MOS transistor is complementary coupled with the P-channel transistor by a connection of the respective drain terminals $D_N$ and $D_P$ thereof and gate terminals $G_C$ through aluminum wire electrodes. The channels $CH_N$ and $CH_P$ of the N-channel and P-channel transistors are defined by the respective source and drain regions thereof. The source $S_N$ of the N-channel MOS transistor is connected to the anode $A_P$ of a first rectifier diode in accordance with the invention defined by the diffused buffer $P^+$ region, the diode being defined by the $N^+$ and P boundary, the diffused $N^+$ region, defining the cathode $K_N$. The source $S_P$ of the P-channel MOS transistor is similarly connected to the cathode $K_N$ of a second rectifier diode in accordance with the invention defined by a diffused buffer $N^+$ region, the diode being defined by the $P^+$ and N boundary, the diffused $P^+$ region defining the anode. The P and N substrates are reversed biased by the current flowing from the anodes $A_P$ and $A_N$ respectively since the P substrate is at a negative potential, and the N substrate is maintained at a positive potential.

FIG. 7 illustrates, by way of example, the circuit of FIG. 6 applied to the driving integrated circuit and rectifier circuit 9 of FIG. 2. The alternating power signal from booster circuit 7' is applied between the anode of diode 20 and the cathode of diode 21. The cathode of diode 20 is connected to a positive power bus 26 while the anode of diode 21 is connected to a negative power bus 27. As pointed out above, the driving integrated circuit would include a decoder 24 and a driver 25. While the decoder and driver can be formed of C-MOS circuits in a well known manner, one inverter circuit 30 thereof consisting of a P-channel MOS transistor 22 and a N-channel MOS transistor 23 connected with their respective drains and gates in common connection and their respective sources coupled to power buses 26 and 27. Diodes 20 and 21 and MOS transistors 22 and 23 correspond to the circuit illustrated in FIG. 6 and like reference numerals are applied to like elements in FIG. 6 for identification thereof. The C-MOS inverter defined by MOS transistors 22 and 23 is gated by a signal from a schematically illustrated input data bus 29 coupled to divider circuit 3'. The output of said C-MOS inverter is connected to an output data bus 28, also schematically illustrated, which is in turn connected to driver 25. In the actual decoder and driver circuit, a plurality of such C-MOS circuits would be provided to effect the decoding and driving function in a known manner.

In general, the current consumed by the liquid crystal display cell and by the integrated circuit driving the same in an electric watch of the type described is of the order of several micro-amperes. Thus, as hereinabove pointed out a highly effective rectifier circuit can be realized with the use of diodes possessed of comparatively small junction areas requiring minimal area on a chip which forms the integrated driving and rectifier circuit. For this reason, the chip defining driving and rectifier circuit 9 and the chip defining integrated driving circuit 4 of FIG. 1 are of comparable size and cost, resulting in a substantial savings in space and cost.

The arrangement according to the invention described above provides a step-up voltage transformer permitting the use of a single conventional low voltage cell in an electronic timepiece. This feature contributes to the provision of a practical and highly reliable quartz crystal watch heretofore unavailable in conventional watch constructions.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electric timepiece comprising a quartz crystal vibrator for producing a high frequency time standard signal; divider circuit means for producing low frequency time signals in response to said high frequency time standard signal; display means for the digital display of time; driving circuit means including complementary coupled MOS transistors disposed intermediate said divider circuit means and said display means for applying driving signals to said display means in response to said time signals, each said transistor including a source and drain; d.c. potential means for energizing said vibrator and divider circuit means; means for stepping up the voltage supplied by said d.c. potential means and supplying said amplified potential to said driving circuit means to provide said driving signals for energizing said display means, said step-up voltage means including rectifier means including diodes for providing said d.c. potential of higher voltage, each said diode having an anode and cathode, at least said driving circuit means, said complementary coupled MOS transistors and said rectifier means diodes being in the form of a monolithically integrated circuit, said integrated circuit being formed from a common substrate, said substrate having in the surface thereof at least a first region of a first conductivity type, at least a first pair of spaced diffused areas in said first region formed of a second conductivity type opposite to that of said first conductivity type and defining the source and drain of one of said complementary coupled MOS transistors, at least a second pair of spaced diffused areas in said first region, a first diffused area of said second pair being of said second conductivity type, a second diffused area of said second pair being of a high concentration of said first conductivity type, said second pair of diffused areas defining the anode and cathode connections of one of said diodes, and insulating and conductive layers on said substrate, said conductive layers in part overlying said insulating layers and in part engaging said diffused areas to define electrical connections thereto, said driving circuit means, said complementary coupled MOS transistors and said rectifier means diodes being defined by diffused areas and insulating and conductive layers of like construction.

2. A timepiece as claimed in claim 1, wherein said d.c. potential means is a single d.c. battery.

3. A timepiece as claimed in claim 2, wherein said step-up voltage means includes means for converting the d.c. signal supplied from the battery to an a.c. signal and means for stepping up the potential of said a.c. signal.

4. An electric timepiece as claimed in claim 1, wherein said substrate has in the surface thereof at least a second region of said second conductivity type, at least a first pair of spaced diffused areas in said first region of said second conductivity type and defining the source and drain of a further one of said complementary coupled MOS transistors.

5. An electric timepiece as claimed in claim 4, including at least a second pair of spaced diffused areas in said second region, a first diffused area of said second pair of diffused areas of said second region being of said first conductivity type, a second diffused area of said second pair of diffused areas of said second region being of a high concentration of said second conductivity type, said second pair of diffused areas of said second region defining the anode and cathode connections of a further one of said diodes.

6. An electric timepiece as claimed in claim 5, wherein said first conductivity type is N and said second conductivity type is P, said first pair of diffused areas of said first region, the first diffused area of said second pair of diffused areas of said first region and the second diffused area of said second pair of diffused areas of said second region being $P^+$, the first pair of diffused areas of said second region, the second diffused area of said second pair of diffused areas of said first region and the first diffused area of said second pair of diffused areas of said second region being $N^+$.

7. An electric timepiece as claimed in claim 1, wherein said first conductivity type is N, said first pair of spaced diffused areas in said first region and said first diffused area of said second pair of diffused areas in said first region being $P^+$, the second diffused area of said second pair of diffused areas of said first region being $N^+$.

8. An electric timepiece as claimed in claim 1, wherein said first conductivity type is P and said second conductivity type is N, said first pair of space diffused areas in said first region and said first diffused area of said second pair of diffused areas of said first region being $N^+$, the second diffused area of said second pair of diffused areas of said first region being $P^+$.

9. An electric timepiece as claimed in claim 1, wherein one of said conductive layers electrically couples the source of said complementary coupled MOS transistor and said second diffused area of said second pair of diffused areas of said first region.

* * * * *